US005896004A

United States Patent [19]

Feldman et al.

[11] Patent Number: 5,896,004

[45] Date of Patent: Apr. 20, 1999

[54] DOUBLE ENDED QUARTZ LAMP WITH END BEND CONTROL

[75] Inventors: Joseph Feldman, Mayfield Heights; Richard L. Hansler, Pepper Pike; Walter R. Chapman, Jr., Cleveland Heights; John M. Davenport, Lyndhurst; Rocco T. Giordano, Garfield Heights; Gary R. Allen, Chesterland; William J. Cassarly, Lyndhurst; Victor A. Levand, Jr., deceased, late of Lyndhurst, by Margaret I. Levand, legal heir; Martin N. Hassink, Macedonia, all of Ohio

[73] Assignee: General Electric Company, Schenectady, N.Y.

[21] Appl. No.: 09/006,719

[22] Filed: Jan. 14, 1998

Related U.S. Application Data

[63] Continuation of application No. 08/390,903, Feb. 16, 1995, abandoned, which is a continuation of application No. 08/130,822, Oct. 4, 1993, abandoned.

[51] Int. Cl.[6] ..... H01J 01/62; H01J 63/04; H01J 17/16; H01J 61/30

[52] U.S. Cl. ..... 313/493; 313/573; 313/634; 313/17; 313/318.02

[58] Field of Search ..... 313/17, 25–26, 313/491–93, 631–34, 573, 318.01, 318.02, 318.07, 318.11; 445/26, 27

[56] References Cited

U.S. PATENT DOCUMENTS

| | | |
|---|---|---|
| 3,293,493 | 12/1966 | Johnson et al. . |
| 3,364,378 | 1/1968 | Beesley . |
| 4,475,061 | 10/1984 | van de Weijer et al. . |
| 4,835,439 | 5/1989 | Essock et al. . . |
| 4,839,559 | 6/1989 | Ahlgren et al. . |
| 4,918,352 | 4/1990 | Hess et al. . |
| 4,959,585 | 9/1990 | Hoegler et al. . |
| 4,968,916 | 11/1990 | Davenport et al. . |
| 4,992,700 | 2/1991 | Lake . |
| 5,032,750 | 7/1991 | Hayashi . |
| 5,107,165 | 4/1992 | Dever et al. . |
| 5,177,397 | 1/1993 | Nagasawa et al. . |

*Primary Examiner*—Sandra O'Shea
*Assistant Examiner*—Mack Haynes
*Attorney, Agent, or Firm*—Fay, Sharpe, Beall, Fagan, Minnich & McKee

[57] ABSTRACT

A linear double ended lamp can be modified into a number of non-linear arrangements by heating selected regions of the lamp ends to the softening temperature and bending the lamp ends to a desired angular configuration. Preferably, the lamp ends are bent across the sealing foil that is hermetically sealed to the lamp envelope. One or both ends of the lamp can be bent as desired to define a variety of configurations. According to the method of forming the bent double ended lamp, selected regions of the lamp are raised above the softening temperature while the remainder of the lamp is maintained at a lower temperature. Preferably, the lamp ends are bent along an axis offset and parallel to the longitudinal axis of the lamp to prevent accumulation of material.

19 Claims, 5 Drawing Sheets

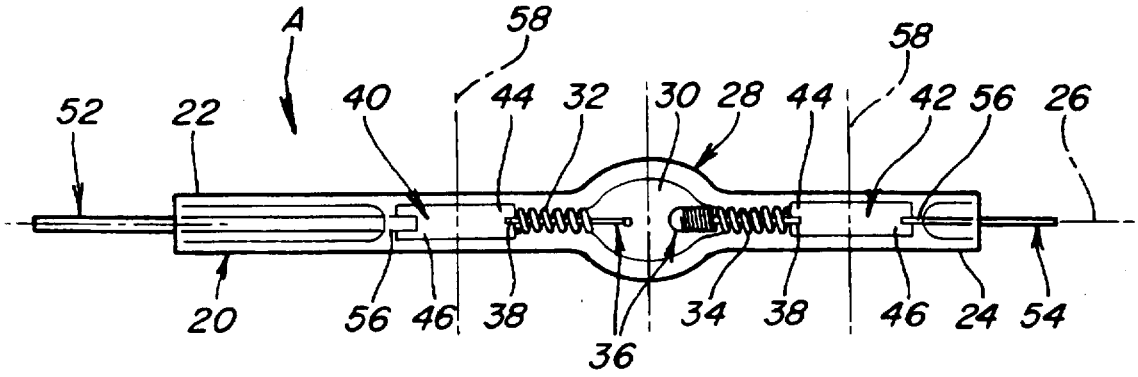
Fig. 1
(PRIOR ART)
Fig. 2
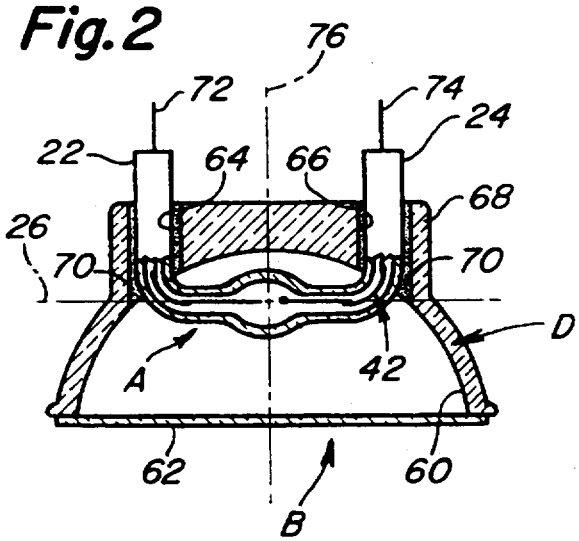
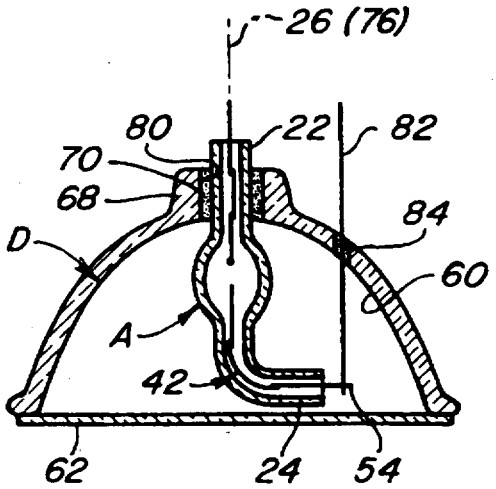
Fig. 3
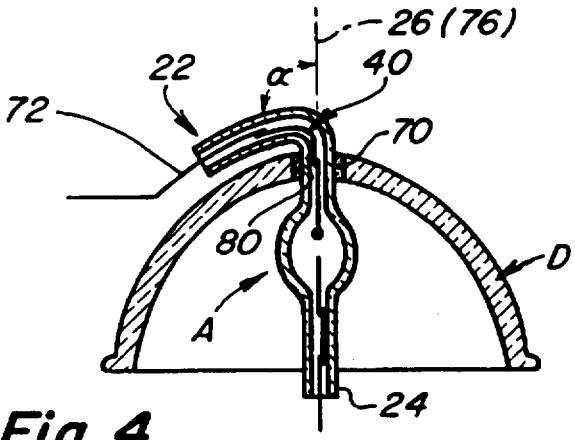
Fig. 4

Fig.5
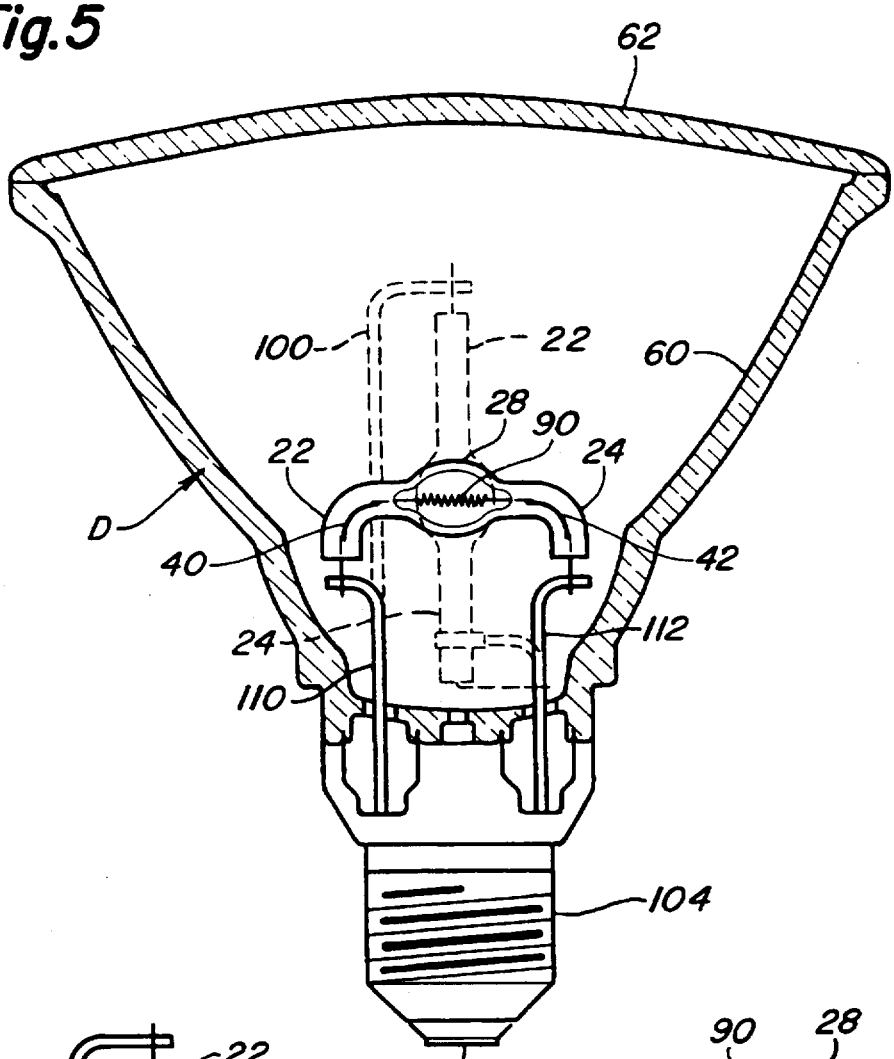
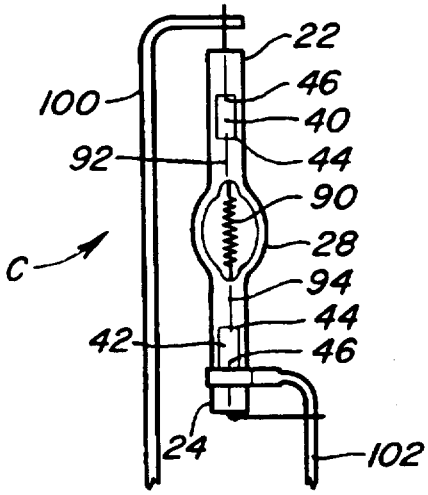
Fig.6
(PRIOR ART)
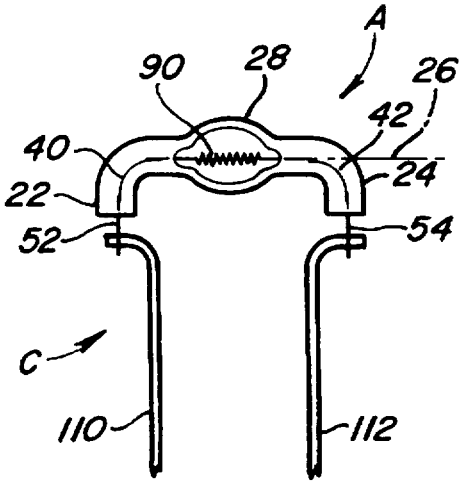
Fig. 7

Fig. 8
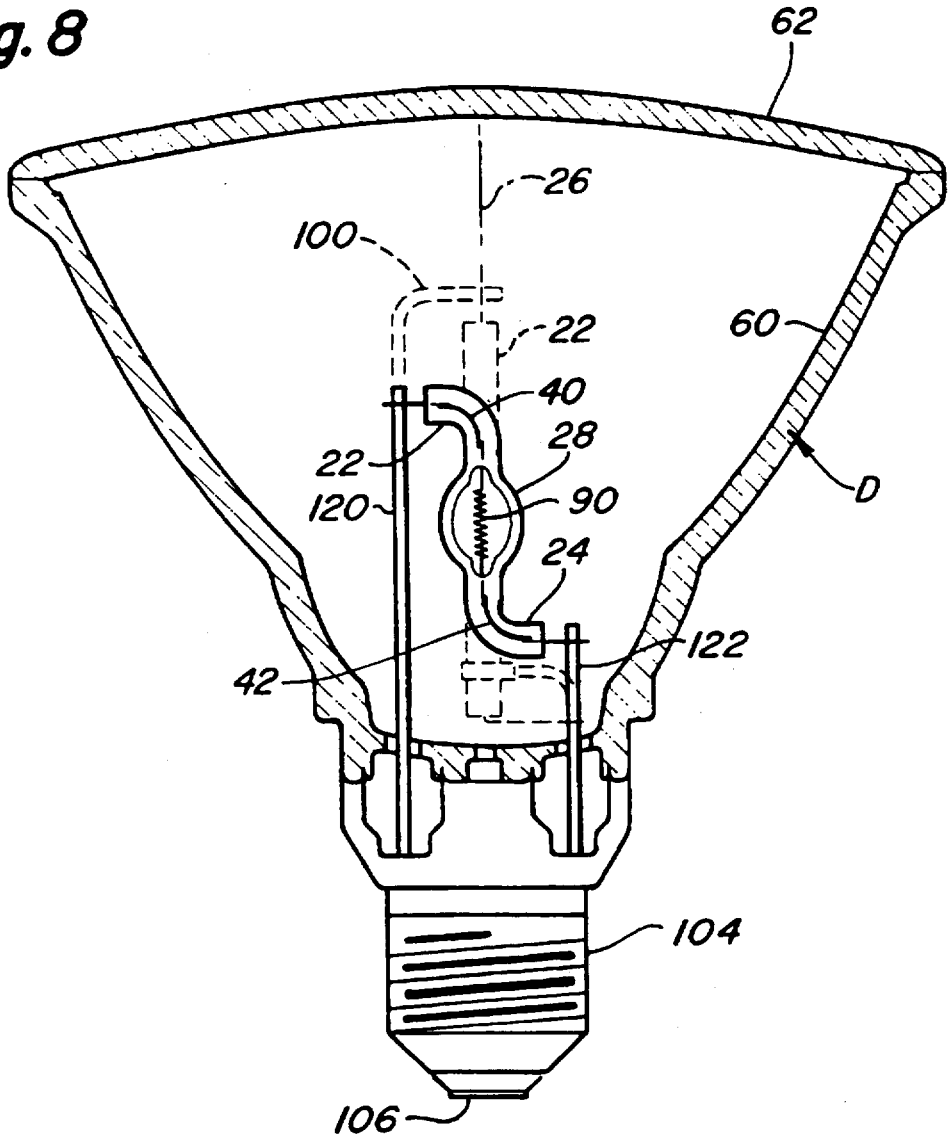
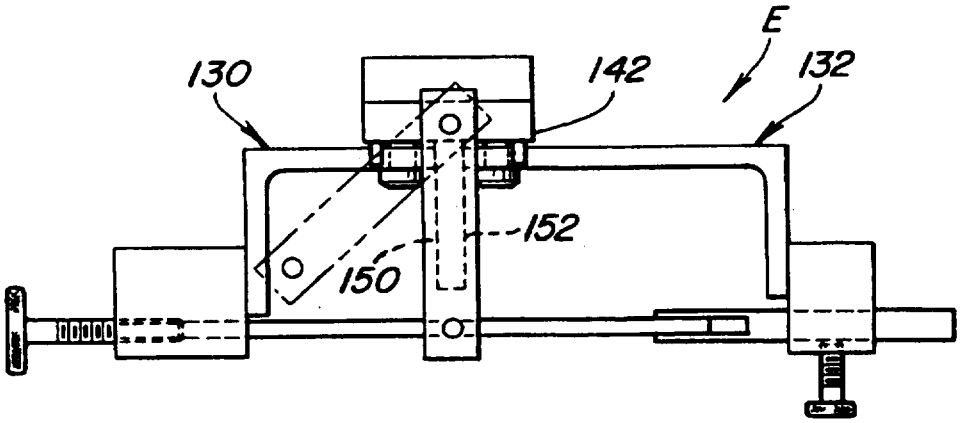
Fig. 12

DOUBLE ENDED QUARTZ LAMP WITH END BEND CONTROL

This application is a continuation of U.S. Ser. No. 08/390,903 filed Feb. 16, 1995, abandoned, which is a continuation of application Ser. No. 08/130,822 filed Oct. 4, 1993, abandoned.

BACKGROUND OF THE INVENTION

This invention pertains to the art of electric lamps and more particularly to filament lamps or arc lamps in which an envelope is hermetically sealed from the external environment. The invention is applicable to electric lamps of this type employing molybdenum sealing foils hermetically sealed in vitreous material where the molybdenum sealing foil interconnects inner and outer leads. However, it will be appreciated that the invention has broader applications and may be advantageously employed in other environments and applications.

Double ended electric incandescent and arc discharge lamps typically employ a vitreous envelope in which a pair of metal inner leads have at least one end that extends into a gas filled cavity of the envelope. A second end of the inner lead is received in the vitreous material and is connected to a sealing element, preferably a sealing foil, that forms a hermetic seal with the envelope. The sealing foil is a thin, planar construction that interconnects the inner lead with an outer lead which, in turn, is connected to a power source. The sealing foil is usually formed from molybdenum having a thickness on the order of approximately 2 mils in order to form an effective hermetic seal with the envelope, typically constructed of a quartz material. Of course, it is understood that other refractory materials than molybdenum can be used to form the sealing foil, such as tungsten, platinum, or palladium.

A double ended lamp of this type, although widely used and commercially successful, occasionally encounters problems because of its structural configuration. Specifically, the elongated configuration of the double ended envelope on occasion makes it difficult to integrate into the overall lighting system.

It is also difficult to provide an effective mount for an elongated double ended envelope. Specially designed mounts are necessary to hold opposite ends of the double ended lamp and in a manner that does not interfere with effective operation of the lamp.

Still another concern with an elongated double ended envelope is that it is not as robust or sturdy as desired. Due simply to its configuration, the envelope presents an arrangement that is unsupported over a large length. Likewise, mounting wires used to secure the double ended lamp are elongated which leads to increased natural frequencies which adversely affects stiffness of the lamp assembly. Accordingly, the envelope is sensitive to damage that may result from shipping, installation, or even in use depending on the particular end use of the lamp.

For certain applications, it may be important to orient the arc or filament in a particular direction, even though it is desired that the remainder of the lighting system is preferred to be oriented in a different direction. For example, it may be desirable to position the arc or filament in a vertical direction. Simultaneously, there may be a competing desire to locate the reflector in a horizontal direction. Thus, it is important in selected applications to be able to position the axis of the filament or arc generally perpendicular to the axis of the reflector.

It has thus been deemed desirable to increase the sturdiness of the mounting arrangement, make the lamp adaptable to a wider array of configurations, and provide the option of orienting the filament/arc generally perpendicular to the reflector.

SUMMARY OF THE INVENTION

The present invention relates to alternative double ended tube configurations and a method of forming these configurations that allow system design flexibility and add to structural integrity of the mounting of the double ended lamp in the system.

According to the invention, the electric lamp includes an envelope that receives an inner lead having a first end extending into an envelope cavity. An outer lead is connected to the inner lead by a thin sealing member that is hermetically sealed in the envelope along at least a portion of its length. Opposite ends of the sealing member are disposed in non-linear arrangement while maintaining a hermetic seal with the envelope.

According to a more limited aspect of the invention, a second inner lead extends into the envelope cavity and is connected to a second outer lead by a second sealing member. The second sealing member also has a non-linear arrangement defined between the first and second ends. In this manner, the lamp may adopt a generally U-shaped, Z-shaped, L-shaped, or arbitrary non-linear configuration as required for a particular system design.

According to a method of forming this type of electric lamp, linear sealing members are hermetically sealed in the envelope to connect inner and outer leads. Thereafter, the temperature of the envelope is elevated along the area of the sealing member and the sealing member permitted to bend to a non-linear configuration.

According to a more limited aspect of the method, the remainder of the envelope is maintained at a lower temperature and the envelope is bent along an axis spaced from a longitudinal axis of the lamp.

According to yet another aspect of the method, one end of the sealing member is supported while the opposite end is permitted to freely deflect to a desired angle in response to the elevated temperature.

A principal advantage of the invention is the ability to obtain alternate design configurations of a double ended lamp while maintaining the integrity of the sealed envelope.

Another advantage is found in the improved shock resistance of the lamp assembly.

Still another advantage of the invention resides in the improved heat sink characteristics of the lamp.

Other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments and a method of which will be described in detail in this specification and illustrated in the accompanying drawings which form a part hereof, and wherein:

FIG. 1 is an elevational view of a double ended, conventional arc discharge lamp with proposed bend line axes illustrated therein;

FIG. 2 is an elevational view of a lamp assembly showing a generally U-shaped arc tube incorporated into a reflector;

FIG. 3 illustrates a generally L-shaped arc tube lamp assembly;

FIG. 4 illustrates an arbitrarily shaped, non-linear arc tube configuration in a lamp assembly;

FIG. 5 discloses a double ended filament tube lamp with a modified mount arrangement;

FIG. 6 discloses a prior art arrangement for mounting a double ended filament tube;

FIG. 7 shows the modified mounting arrangement for a generally U-shaped filament tube;

FIG. 8 is a view shown partly in cross section of a generally Z-shaped filament tube;

FIG. 12 is a top plan view of the apparatus of FIG. 10.

DETAILED DESCRIPTION OF THE PREFERRED EMBODIMENTS AND METHOD OF FORMING SAME

Figure 9:
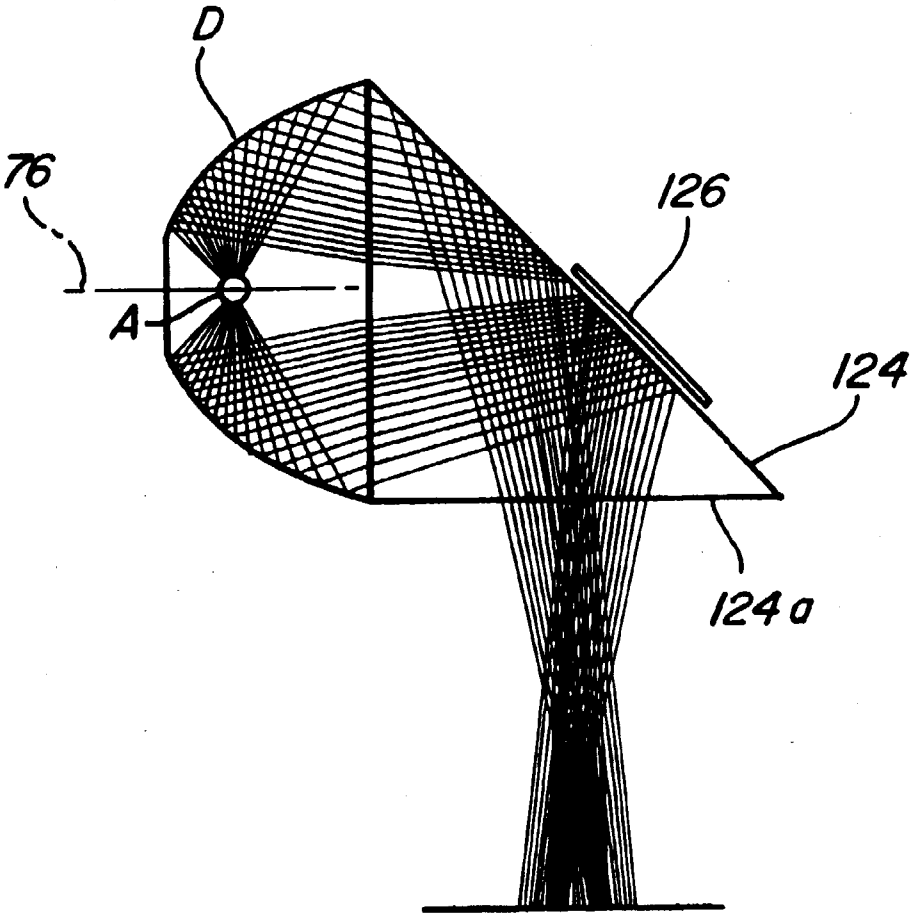
FIG. 9 illustrates a lamp and reflector assembly including a ray-tracing therefor and which uses the arc tube of the present invention and incorporates a prism member as a cover to the reflector.

Referring now to the drawings wherein the showings are for purposes of illustrating the preferred embodiments and method of the invention only, and not for purposes of limiting same, the FIGURES show a double ended lamp A such as used in a lamp assembly B. A mounting structure C locates the lamp relative to a reflector or lamp housing having a reflector D, the details of the reflector or lamp housing being well known to those skilled in the art so that further discussion herein is deemed unnecessary.

More particularly, and with reference to FIG. 1, the double ended lamp A is typically an elongated cylindrical tubing or envelope 20 having first and second ends 22, 24 aligned with one another along a longitudinal axis 26. Disposed between the ends is an enlarged, generally elliptical portion 28 defining a hollow cavity 30 which is sealed from the external environment. The tubing or envelope is usually a vitreous material such as fused quartz that has desired refractory properties and optical transparency as required for a particular lamp system design. The cavity 30 is hermetically sealed at opposite ends and contains a fill of various materials. For example, the fill may include mercury, a metal halide, or one or more inert gases such as krypton, argon, or xenon. These materials become vaporized during a discharge operation which is achieved by supplying electrical current to first and second inner leads or electrodes 32, 34. Each inner lead has a first end 36 disposed within the cavity 30. Second or outer ends 38 of the inner leads extend generally axially from the cavity for connection with a sealing member, such as a sealing foil 40 or 42. Each sealing foil is of identical construction so that description of one is fully applicable to the other.

The sealing foils are elongated, thin planar foils, preferably formed of molybdenum that are sealed in the tubing ends 22, 24 at an area axially spaced from the cavity. The sealing foil is a conventional structure and is widely used in the prior art to provide a thin but effective interconnection at inner ends 44 with the respective second ends 38 of the inner leads 32, 34. Second or outer ends 46 of the sealing foils are, in turn, connected to outer leads or conductors 52, 54. More particularly, the second ends 46 of the sealing foils are secured to inner ends 56 of the outer leads.

As indicated above, the sealing foil is generally planar and has a rectangular cross section with a preferred thickness of approximately 2 mils or less. The quartz envelope is sealed along the foil to hermetically seal the envelope from the external environment in a manner well known in the arts. Particular attention must be given to the sealing foil interfaces with the quartz since leakage or oxidation along the sealing foil adversely affects operation of the lamp. Accordingly, it is widely accepted in the industry that once a bond is formed between the foil and vitreous material, that area is left alone so as not to disturb the seal.

Unfortunately, the double ended lamp configuration has heretofore encountered other difficulties from a system design standpoint as described above. It is generally perceived that the extended length of the double ended lamp is merely a design constraint since no effective manner of altering the linear shape of the lamp was known. The subject invention, though, is able to provide non-linear configurations of the double ended lamp without compromising the hermetic seals.

For example, and with additional reference to FIG. 2, the lamp assembly B includes a modified double ended lamp that has been bent along the sealing foil at least one end. The bending regions are preferably defined along the sealing foil across the flat side of the foil as represented in FIG. 1 by bend axes 58. More particularly, the lamp assembly includes a reflector housing D having a curvilinear inner surface 60 that directs light from the double ended lamp located at the focus of the reflector outwardly through lens or cover member 62. Lens or cover member 62 may include a multi-layer hot-mirror coating which can reduce the visible reflection loss and also reduce the infrared and ultraviolet light otherwise transmitted through the glass material of the cover member 62. The cover member material is also effective for absorbing shorter wavelength ultraviolet light and for containing fragments of material that may be present in the event of damage to the lamp assembly B.

Because of the extended overall length of the double ended lamp, it would heretofore have been very difficult to incorporate this type of lamp into a housing of this size. A pair of mounting openings 64, 66 are provided in base 68 of the reflector housing. The openings are adapted to receive the opposite ends 22, 24 of the lamp and the lamp ends are secured in the openings by a suitable cement, adhesive, or other fastening arrangement 70. In the embodiment of FIG. 2, each of the ends 22, 24 have been bent approximately 90° from the longitudinal axis 26 to define a generally U-shaped configuration. In other words, the ends 22, 24 of the lamp define a pair of legs that extend along respective axes 72, 74. The axes 72, 74 are parallel and offset from the central axis of the reflector housing. Without the ability to bend the double ended lamp, the ends 22, 24 could not be received within the reflector housing or the housing would have to be modified to accommodate this extended length. Additionally, location of the arc source at the focus of the reflector surface 60 is easily accommodated with the bent configuration in accordance with the subject invention.

The FIG. 2 arrangement accomplishes many of the objectives previously unattainable in the prior art. Since the overall length of the double ended lamp is now reduced, a lens 62 can be mounted over the end of the reflector housing without interfering with the lamp. Additionally, the light source can be accurately located at the focus of the reflective surface 60. Still further, the bent lamp design has improved shock resistance because the mounting wire length is decreased. That is, the natural frequency of the mounting wire decreases inversely proportional to the length squared.

Since the mounting wire length is decreased, the system stiffness is increased allowing better separation of component natural frequencies. The combination of higher mounting structure and natural frequencies and better component frequency separation improve the overall shock resistance of the assembly. Moreover, the cemented legs of the lamp facilitate conductance of heat from the closed housing which protects the sealing foils and adjacent structure from detrimental effects associated with elevated temperatures. An additional benefit of this configuration is that the axis 26 through the lamp can be oriented approximately 90° from the longitudinal axis 76 of the reflector.

FIG. 3 illustrates another preferred embodiment where only one end of the lamp has been bent approximately 90° relative to the longitudinal axis 26. As shown, the first end 22 is received through a central opening 80 in the reflector housing base 68. Again, a cement 70 or alternate fastening arrangement can be used to secure the first end of the lamp in the housing opening. The second end 24 of the double ended lamp is bent approximately 90° relative to axis 26. Therefore, as is apparent, axis 26 that is common to the inner leads 32, 34 is aligned with the central axis 76 of the reflectors. To achieve this configuration, the second end of the lamp is bent across the flat side of the sealing foil 42 not labeled generally along bend axis 58 (FIG. 1). The second end outer lead 54 is thus disposed generally perpendicular to axis 26 that extends through the inner leads and, when mounted, coincides with central axis 76 of the reflector housing. This outer lead is secured by a mounting structure such as wire 82 received through an opening 84 in the reflector. The mounting wire not only secures the second end of the lamp but also electrically connects the outer lead 54 to the power source (not shown).

Turning to the embodiment of FIG. 4 where, again, like numerals will refer to like elements while new components are identified by new numerals, an arbitrary non-linear bent arrangement is illustrated therein. As shown, the first end 22 is bent at an angle greater than 90° from the axis 26 which coincides with the central axis 76 of the reflector housing. The degree of bend is represented by the angle alpha ($\alpha$) in FIG. 4 which is measured between the longitudinal axis 26 and the axis 72 defined by the first end of the lamp. Although the leg is bent somewhere between 90° and 180°, it will be understood by one skilled in the art that any angle greater than 0° and less than 180° is contemplated within this arrangement. In other words, a non-linear arrangement is intended.

The first end 22 is received through the central opening 80 in the housing and, again, secured by cement or an alternative securing arrangement 70. Since the second end 24 is not bent in this embodiment, the lens 62 cannot be received over the end of the reflector housing. In some lighting systems, this may be acceptable, although in still other arrangements it may be desired to bend the second end 24 approximately 90° from the axis 26 to accommodate a lens on the reflector housing if so desired. In any event, this embodiment is intended to illustrate that other angular arrangements can be used, or that only a single end of the lamp need be bent.

The embodiment of FIGS. 5–7 discloses the applicability of the bent double ended lamp to filament tubes also. Opposite ends of an incandescent filament 90 define the inner lead in this type of a lamp so that opposite ends 92, 94 of the filament are secured to the first ends 44 of the sealing foils 40, 42, respectively. Although different fill materials may be used, the remaining structure of the double ended lamp is generally the same as that described above. That is, it still employs a molybdenum sealing foil which connects to a pair of outer leads or conductors 52, 54 at their second ends 46. With additional reference to FIG. 6, and as illustrated in phantom in FIG. 5, the prior art manner of mounting a double ended lamp is illustrated. Particularly, the mounting structure includes a first wire 100 that supports the first end 22 of the lamp. Likewise, a second wire 102 supports the second end 24 of the lamp. The first and second ends 22, 24 are aligned in the prior art arrangement and the central envelope 28 is located at the focus of a parabolic reflector 60. Lower ends of the mounting wires are secured in the lamp assembly base and electrically connected to an externally threaded conductive metal shell 104 and an electrically conductive metal contact or ring 106 to supply current to the lamp assembly.

Shown in solid line in FIG. 5, and individually represented in FIG. 7, a modified pair of mounting wires 110, 112 secure opposite ends of the bent double ended lamp to the base of the lamp assembly. As shown, the outer leads 52, 54 are secured to mounting wires 110, 112, respectively. Moreover, the molybdenum sealing foils are bent approximately 90° across the flat side of the sealing foil along the bend axes 58 (FIG. 1). In this preferred arrangement, each of the ends 22, 24 is disposed generally perpendicular to an axis 26 extending through the filament. This provides a symmetrical, stiffly mounted arrangement that improves the shock resistance as described above.

Still other arrangements than the generally U-shaped double ended lamp can be used. For example, a generally Z-shaped lamp configuration is shown in FIG. 8. There, the axis 26 extending through the filament 90 is aligned with the central axis of the reflector and is generally perpendicular to the arrangement shown in FIG. 5. Nevertheless, this arrangement has the advantages over the prior art configuration of FIG. 6 in that a mounting wire 120 is substantially reduced in length relative to the mounting wire 100. Thus, even though the length of mounting wire 120 is slightly greater than that of mounting wire 110 in the FIG. 5 embodiment, it still is less than the prior art arrangement. Since the mounting wire length is decreased and the system stiffness thereby increased, the shock resistance is again improved in the overall assembly. The opposite ends 22, 24 of the double ended lamp are each bent approximately 90° relative to the axis 26 but in opposite directions. Of course, other angular arrangements or mounting structures can be used without departing from the scope and intent of the subject invention.

As seen in FIG. 9, an application of the double ended lamp A having bent ends so as to be contained within the contour of a reflector D, utilizes a prism 124 to bend light output in a direction 90° away from the central axis 76 of the reflector D. The prism member 124 in this application is sized to cover the open end of reflector D, and as such, acts in the same manner as the cover member 62 of FIG. 2 in that, should the lamp A be damaged, broken parts are prevented from escape. Additionally, the prism member 124 serves to protect the light source A from accidental damage as could occur for instance if objects were placed in close proximity to and accidentally contacted the light source A, reflector D configuration. A small cold mirror 126 could be placed behind the prism member to reflect that light output which is not totally internally reflected by the prism 124. Use of prism member 124 also allows the use of a color wheel (not shown) at the light output side 124*a*. Of course, it can be appreciated that the use of a prism member 124 over the open end of reflector D could also provide beneficial advantages in terms of light handling capabilities even without the use of the light source A having the bent ends. This could be accomplished for instance if an annularly shaped extender collar (not shown) was placed over the open end of reflector D and the prism members 124 then attached to the collar member at a point beyond where the straight lamp end (not shown) would reside.

Figure 11:
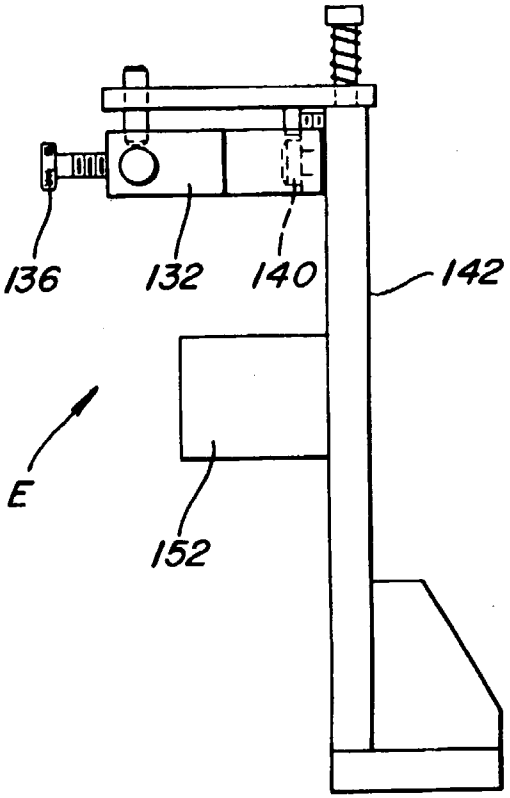
FIG. 11 is an elevational view taken from the right-hand end of FIG. 10.
Figure 10:
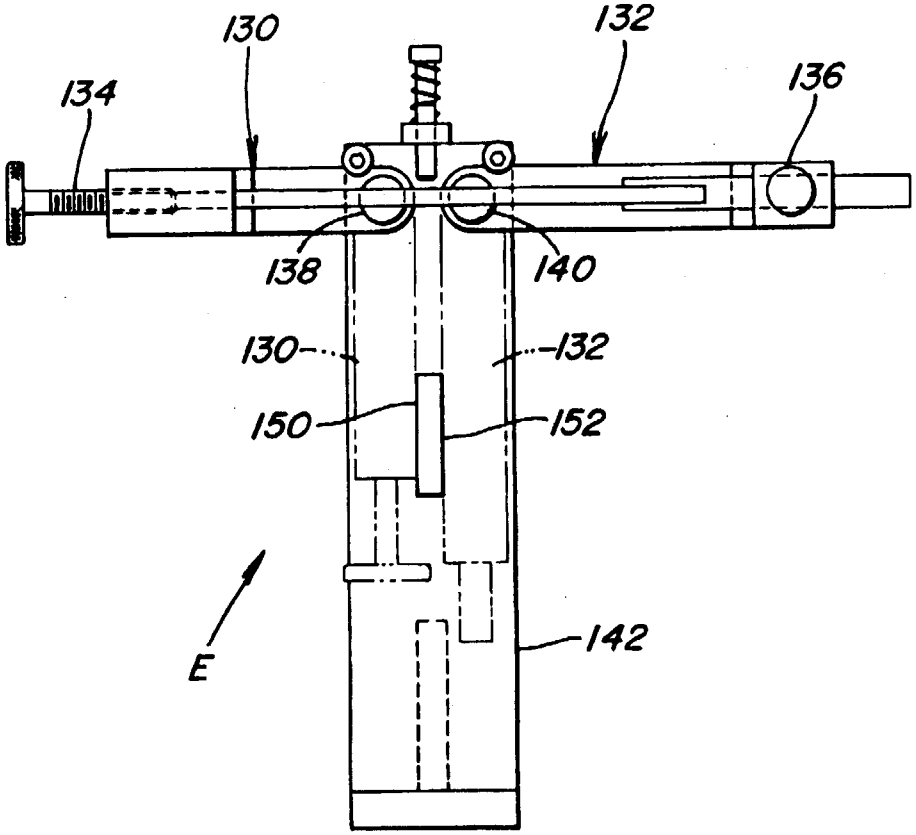
FIG. 10 is an elevational view of an apparatus used for bending a double ended lamp into non-linear configurations.

FIGS. 10–12 illustrate a preferred apparatus or bending tool E that facilitates a method of manufacturing bent double ended lamps. Particularly, the apparatus E has a pair of arms 130, 132 adapted to receive the first and second ends 22, 24, respectively, of a linear double ended lamp therein. Adjustable clamps 134, 136 assist in retention of the ends of the double ended lamp. Each of the arms 130, 132 is adapted for pivotal movement or rotation about pins 138, 140 that extend through the arms and into a base 142 of the bending tool apparatus.

As described above, and as shown in FIG. 1, a double ended lamp, in which opposite ends 22, 24 are aligned or in a linear configuration, is formed in a manner well known in the art. After the lamp has been sealed, the elongated lamp of FIG. 1 is positioned in the bending tool. The opposed ends 22, 24 are clamped via clamps 134, 136 in arms 130, 132. The lamp is heated adjacent the bend axes 58 so that the temperature of the vitreous material is raised to its melting point at these areas. These bend areas preferably coincide with the location of the sealing foils in the first and second ends 22, 24. The remainder of the lamp is maintained at a temperature well below the melting point of the quartz. For example, the remaining portions of the lamp ends can be flushed with an inert gas, such as nitrogen, as the particular bend regions are heated.

The temperature is raised to the softening point (approximately 1100° to 1200° C. for quartz) of the vitreous material. It has been determined that if the lamp ends are bent along the center lines, i.e., along axis 26, the quartz material has a tendency to accumulate or bunch along the inside radius of the bent corner. This could adversely affect the hermetic seal between the sealing foil and the quartz. Therefore, the preferred bending tool will preferably hold the lamp and allow it to seek its own radius once the bend region has reached the softening temperature. It is believed, therefore, that the lamp end bends or pivots about a point offset from the longitudinal axis 26 of the lamp. By providing suitable stop surfaces 150, 152 at the desired angular configuration of the lamp ends, the extent of pivoting about pins 138, 140 can be controlled. As will also be recognized, if only one leg is to be bent, heat is only applied along one of the axes regions 58.

The stiffness of the hardened quartz is sufficient to prevent deflection of the arms 130, 132 under the influence of gravity. It is only when the axes regions 58 are heated to the softening point of the quartz material that the lamp end is permitted to seek a desired degree of bend or angular configuration. In this manner, a linear double ended lamp is modified to a non-linear configuration.

It will be understood that some force can be used to assist in the deflection of the lamp end(s) when it has been heated to its softening point. Preferably, though, the weight of the arms 130, 132, the temperature of the lamp end, and any applied force are closely controlled so that no stresses or cracks are induced in the finished lamp.

The invention has been described with reference to the preferred embodiments and method. Obviously, modifications and alterations will occur to others upon a reading and understanding of this specification. For example, still other apparatus or tools can be used to perform the bending operation in accordance with the general steps outlined above. Moreover, the lamp can be bent along regions other than the sealing foil, although the sealing foil bending region is presently preferred. It is intended to include all such modifications and alterations insofar as they come within the scope of the appended claims or the equivalents thereof.

What we claim as new and desire to secure by Letters Patent of the United States is:

1. A double ended electric lamp comprising:

an envelope having an internal cavity;

a first inner lead having a first end extending into the envelope cavity;

a second inner lead generally aligned along a longitudinal axis with the first inner lead and having a first end that extends into the envelope cavity;

at least one outer lead;

a sealing member intermediately located and electrically connecting the outer lead to the first inner lead, the sealing member being hermetically sealed in the envelope along at least a portion of its length, the sealing member having first and second ends operatively connected to the first inner lead and the outer lead, respectively, the first and second ends being disposed in a non-linear configuration.

2. The double ended electric lamp as defined in claim 1 wherein the first and second ends of the sealing member are disposed in generally perpendicular relation.

3. The double ended electric lamp as defined in claim 1 wherein the first and second ends of the sealing member are angularly disposed relative to one another where the angle is greater than 0° and less than 90°.

4. The double ended electric lamp as defined in claim 1 wherein the first and second ends of the sealing member are angularly disposed relative to one another where the angle is greater than 0° and less than 180°.

5. The double ended electric lamp as defined in claim 1 wherein the sealing member is a foil strip of molybdenum.

6. The double ended electric lamp as defined in claim 1 wherein the sealing member has a longitudinal dimension greater than a width dimension and substantially greater than a depth dimension, the sealing member being bent along the longitudinal dimension.

7. The double ended electric lamp as defined in claim 1 further comprising a second outer lead, and a second sealing member intermediately located and electrically connecting the second inner lead to the second outer lead.

8. The double ended electric lamp as defined in claim 7 wherein the second sealing member has first and second ends disposed in non-linear configuration.

9. The double ended electric lamp as defined in claim 8 wherein the outer leads are bent in the same direction from the inner leads to define a generally U-shaped configuration.

10. The double ended electric lamp as defined in claim 8 wherein the outer leads are bent in opposite directions from the inner leads to define a generally Z-shaped configuration.

11. A method of forming an electric lamp having an envelope with an internal cavity, at least one inner lead having a first end extending into the envelope cavity and a second end connected to a first end of a thin sealing member, a second end of the sealing member connected to an outer lead, the sealing member hermetically sealed in the envelope along a portion of its length, the method comprising the steps of:

elevating the temperature of the envelope along the sealing member;

bending the sealing member and envelope to dispose the first and second ends of the sealing member in non-linear relation.

12. The method as defined in claim 11 wherein the elevating step includes maintaining a remainder of the envelope at a lower temperature.

13. The method as defined in claim 11 wherein the bending step includes supporting one of the first and second ends of the sealing member and permitting an unsupported portion of the sealing member and envelope to freely deflect in response to the elevated temperature.

14. The method as defined in claim 13 wherein the bending step further includes terminating the free deflection of the unsupported portion of the sealing member and envelope at a desired location.

15. The method as defined in claim 11 wherein the sealing member has a longitudinal dimension greater than a width dimension and substantially greater than a depth dimension and the bending step includes deflecting the sealing member across the longitudinal dimension.

16. The method as defined in claim 11 wherein the electric lamp includes a second inner lead aligned with the first inner lead, the second inner lead having a first end extending into the envelope cavity and a second end connected to a first end of a second thin sealing member, a second end of the second sealing member connected to a second outer lead, the second sealing member hermetically sealed with the envelope along a portion of its length, and comprising the further steps of:

elevating the temperature of the envelope along the second sealing member; and bending the second sealing member and envelope to dispose the first and second ends of the second sealing member in non-linear relation.

17. An electric lamp and reflector assembly comprising:

a double ended electric lamp including an envelope with an inner cavity formed therein and first and second inlead assemblies disposed within opposing ends formed on said envelope;

wherein said first and second inlead assemblies include respective sealing members which are hermetically sealed within said opposing ends of said envelope;

at least one of said opposing ends of said envelope being bent at an angle relative to the longitudinal axis of said electric lamp;

a curved reflector member in which said electric lamp is mounted; and wherein said electric lamp is mounted within said reflector member so as to avoid any portion extending beyond an outer rim of said reflector member.

18. An electric lamp and reflector assembly as defined in claim 17 further comprising a cover member disposed over said outer rim of said reflector member.

19. An electric lamp and reflector assembly as set forth in claim 18 wherein said cover member is a prism.

* * * * *